US007479027B1

(12) United States Patent
Miller et al.

(10) Patent No.: US 7,479,027 B1
(45) Date of Patent: Jan. 20, 2009

(54) CABLE CLAMP

(75) Inventors: Keith Edwin Miller, Manheim, PA (US); Ricardo Lee Koller, Lititz, PA (US); Dominic Anthony Farole, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/027,339

(22) Filed: Feb. 7, 2008

(51) Int. Cl.
*H01R 13/00* (2006.01)

(52) U.S. Cl. ..... 439/461; 439/462

(58) Field of Classification Search ..... 439/460, 439/445, 461
See application file for complete search history.

(56) References Cited

U.S. PATENT DOCUMENTS 3,638,169 A 1/1972 Caveney et al.
3,732,526 A 5/1973 Punako
4,606,596 A 8/1986 Whiting et al.
4,802,865 A * 2/1989 Alibert ..... 439/461
6,478,609 B1 11/2002 Davis et al.
6,706,970 B2 3/2004 Laub et al.

OTHER PUBLICATIONS

Tyco Electronics Corporation Brochure 6-1773445-3-GIC; CPC Medical Connector; Mar. 28, 2007; six pages.

* cited by examiner

*Primary Examiner*—Briggitte R Hammond

(57) ABSTRACT

An electrical connector including a connector housing and a cable clamp for providing strain relief to a cable that includes wires terminated to contacts within the connector housing is disclosed. The cable clamp includes a midpiece, cable retention fingers, and a rotating clamp. The rotating clamp includes cable tightening ramps that have a generally radial wedge shape that apply a force to the cable retention fingers when the rotating clamp is securely assembled to the midpiece, providing strain relief to the cable. The cable retention fingers may be an integral part of the midpiece or may be provided as a part of a separate component.

18 Claims, 9 Drawing Sheets

CABLE CLAMP

FIELD OF THE INVENTION

The present invention relates generally to electrical connectors. More specifically, the present invention relates to an electrical connector that includes a clamp for providing strain relief to wires connected to contacts contained within the connector.

BACKGROUND OF THE INVENTION

Electrical connectors for mechanically and electrically interconnecting groups of individual electrical conductors, such as wires or a cable, are well known. The wires are terminated to contacts within the connectors. In many applications, strain may be applied to the wires, for example when disconnecting the connector, that can be detrimental to the connector. Strain can result in one or more wires being pulled from the contacts and/or disconnected from the connector.

It is well known in the art to use a strain relief for electrical connectors terminated to wires or a cable to minimize stress on the wires or cable. The strain relief prevents forces applied to the wires from being transmitted to the contacts where the wires are terminated to prevent the wires from being disconnected or damaged.

Typically, the strain relief apparatus includes separate members that are securable around the housing and wires. The separate members may be secured together by a variety of methods, such as, external hardware or interlocking features. Attaching the strain relief to the connector requires that the connector and wires be positioned in one of the strain relief members and then securing the separate members of the strain relief apparatus together.

Thus, an objective of the present invention is to provide an electrical connector having strain relief that is simple and inexpensive to manufacture and install, but extremely effective in preventing forces applied to the wires from being transmitted to the contacts. A further objective of the present invention is to tighten the strain relief without axial movement of the strain relief relative to the connector, thereby providing a smooth interface between the strain relief and the connector. Additionally, it is a further objective to provide strain relief to cables of varying diameters using the same strain relief components while maintaining a smooth external transition between the components of the strain relief.

SUMMARY OF THE INVENTION

An electrical connector for terminating wires contained within a cable includes a housing comprising contacts and a cable clamp attached to the housing. The cable clamp includes a midpiece, a rotating clamp securely assembled to the midpiece, and cable retention fingers disposed within the rotating clamp. The cable retention fingers may be integral to the midpiece or may be provided as a separate component. The rotating clamp is configured to apply a force to the cable retention fingers, the cable retention fingers providing strain relief to the cable to prevent the wires from being physically and electrically disconnected from the contacts under nominal operating conditions.

A strain relief clamp is disclosed that includes a midpiece, a rotating clamp securely assembled to the midpiece, and cable retention fingers disposed within the rotating clamp. The cable retention fingers may be integral to the midpiece, or the cable retention fingers may be provided as a separate component. The rotating clamp is configured to apply a force to the cable retention fingers, the cable retention fingers providing strain relief to the cable to prevent the wires from being physically and electrically disconnected from the contacts under nominal operating conditions.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
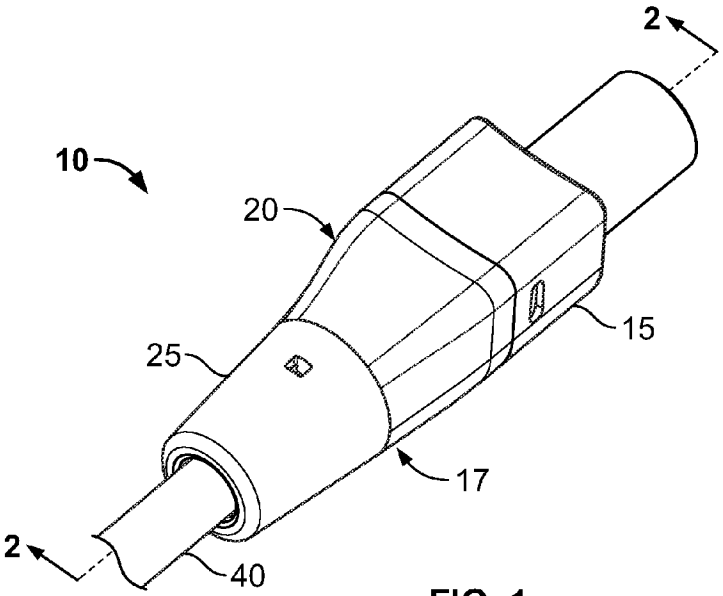
FIG. 1 illustrates a top perspective view of an exemplary electrical connector of the present invention.
Figure 2:
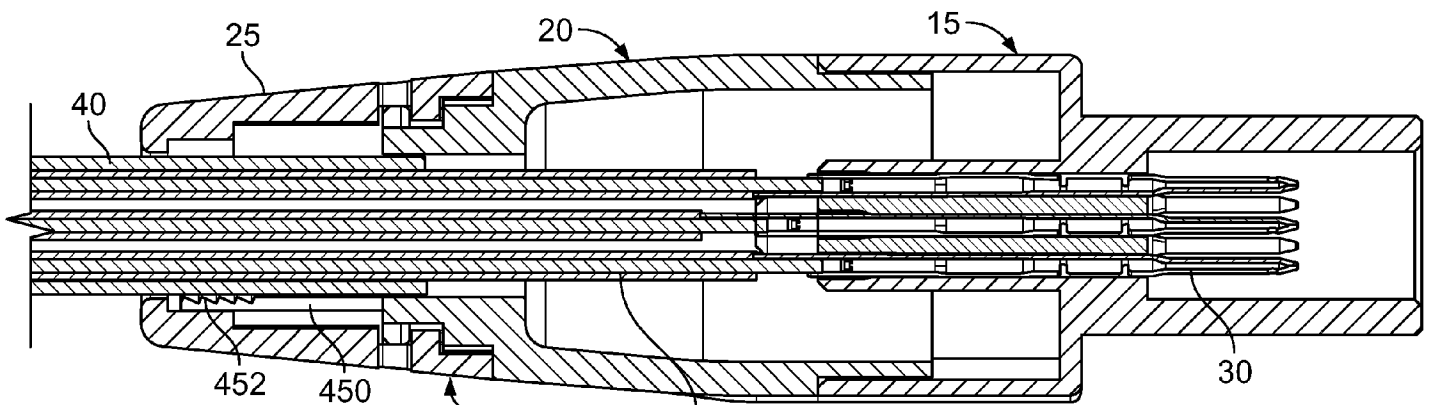
FIG. 2 illustrates a cross sectional view of the electrical connector taken along line 2-2 of FIG. 1.

With reference to FIGS. 1 and 2, an exemplary embodiment of an electrical connector 10 for terminating wires 35 of cable 40 is disclosed. The electrical connector 10 includes a housing 15 and a cable clamp 17. The housing 15 contains contacts 30, which terminate wires 35 of the cable 40. The number of wires 35 and contacts 30 may vary based on the size and application of the connector 10. The cable clamp 17 includes a midpiece 20 and a rotating clamp 25. The housing 15 and the cable clamp 17 are shown having a generally rectangular cross-section, however, it should be apparent to one of ordinary skill that the cross-section of the housing 15 and cable clamp 17 may be square, circular or any other geometry.

Figure 3:
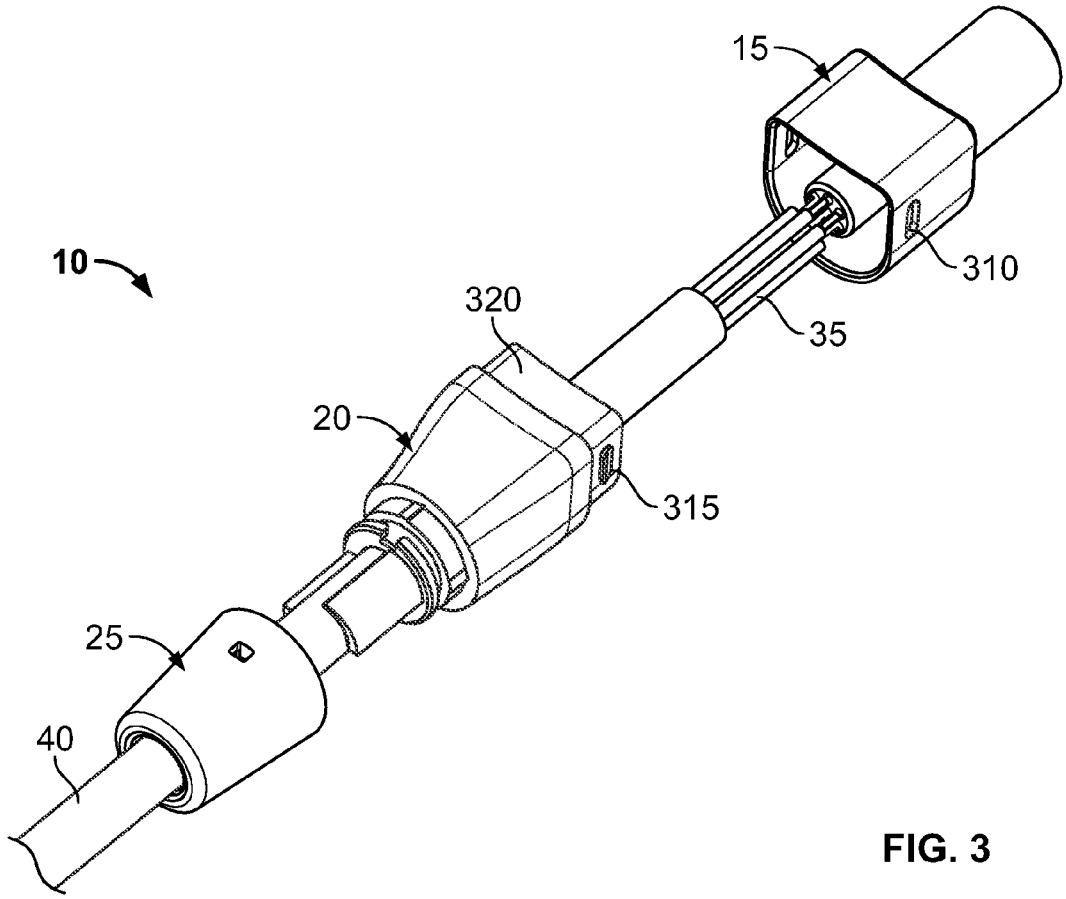
FIG. 3 illustrates an exploded view of the electrical connector of FIG. 1.

An exploded view of the connector 10 is shown in FIG. 3. As can be seen in FIG. 3, the housing 15 includes recesses 310 configured to receive protrusions 315 on a connector aligning portion 320 of midpiece 20. The connector aligning portion 320 is sized to be received inside of the housing 15. When the connector aligning portion 320 is inserted into the housing 15, the engagement of the protrusions 315 in the recesses 310 securely join the housing 15 and midpiece 20 together.

FIGS. 4A, 4B, 4C and 4D show an exemplary embodiment of the midpiece 20. As can be seen in FIGS. 4A-D, the midpiece 20 includes a connector aligning portion 320, a midpiece body 410, a sleeve 420, a groove 430, a retention ring 440 and cable retention fingers 450. The retention ring 440 includes slots 441.

The connector aligning portion 320 includes two protrusions 315 that assist in securely assembling the midpiece 20 to the housing 15, however, in alternative embodiments, the number, structure and position of the protrusions 315 may vary, as would be appreciated by one of ordinary skill in the art. In alternative embodiments of the invention, the connector aligning portion 320 may include alternate and/or additional structures in place of the protrusions 315, and the housing 15 may be accordingly modified to engage such alternate and/or additional structure to assist in securely assembling the midpiece 20 to the housing 15, as would be further appreciated by one of ordinary skill in the art. Additionally, the connector aligning portion 320 and the midpiece body 410 are shown to have a generally rectangular cross-section, however, in alternative embodiments, the cross-section of either or both components may be square, circular or any other geometry.

The sleeve 420 includes sleeve teeth 421, and although the sleeve 420 is shown to include four sleeve teeth 421 equally spaced around the periphery of the sleeve 420, any number of sleeve teeth 421 may be disposed in any spacing arrangement around the periphery of the sleeve 420.

Disposed between the sleeve 420 and retention ring 440 is groove 430, with the retention ring 440 forming a defining surface of the groove 430. Retention ring 440 includes radially disposed slots 441. In alternative embodiments, one or more than two slots 441 may be included.

Figure 4A:
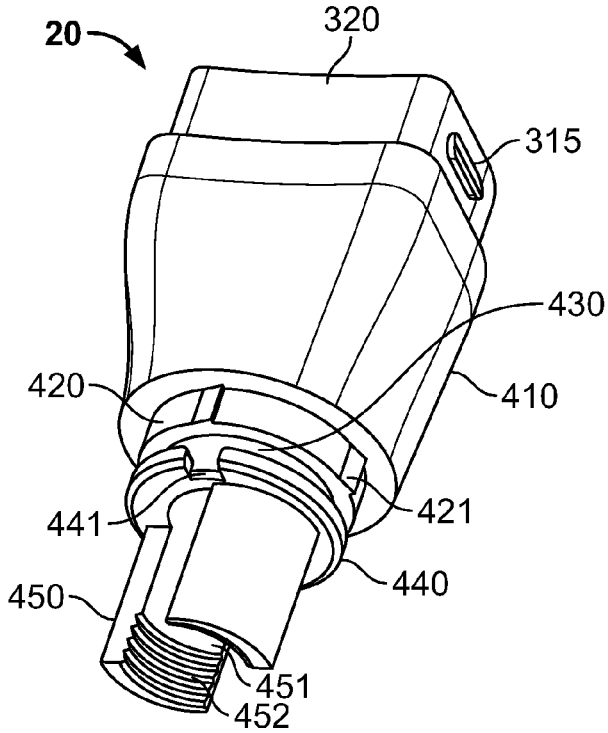
FIG. 4A illustrates a isometric view of an exemplary midpiece according to an embodiment of the present invention.
Figure 4B:
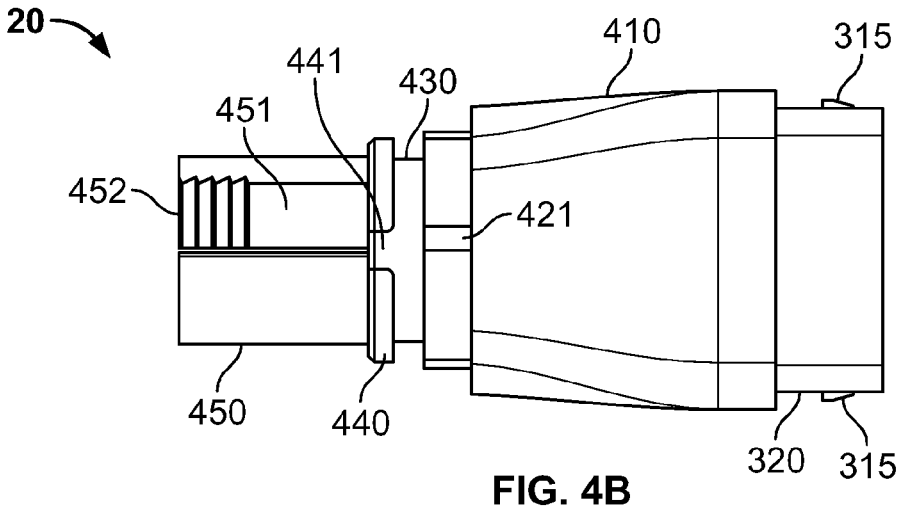
FIG. 4B illustrates a top orthographic view of the exemplary midpiece of FIG. 4A.
Figure 4C:
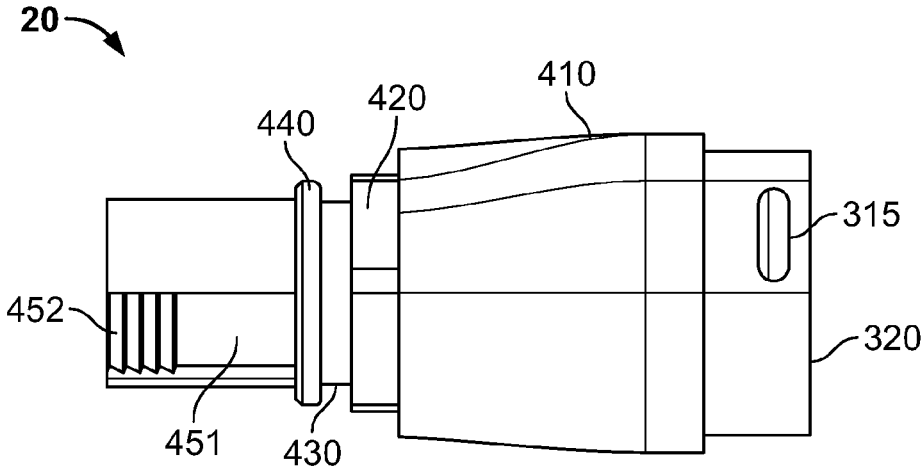
FIG. 4C illustrates a side orthographic view of the exemplary midpiece of FIG. 4A.
Figure 4D:
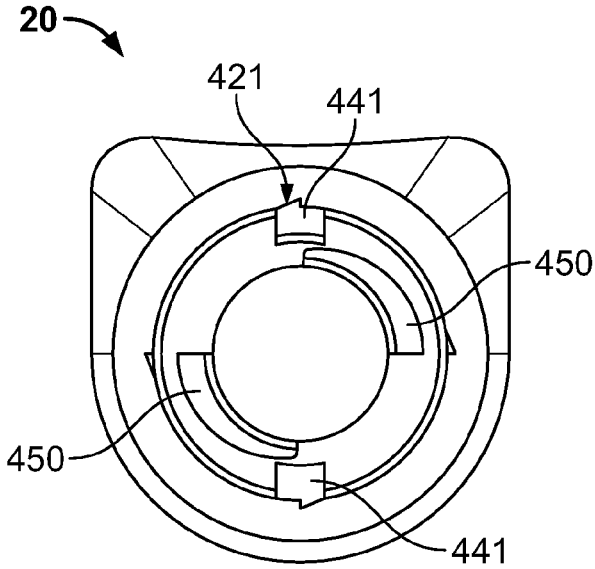
FIG. 4D illustrates a front orthographic view of the exemplary midpiece of FIG. 4A.

Cable retention fingers 450 extend away from the retention ring 440. In this exemplary embodiment, the cable retention fingers 450 are integrally formed as a part of the midpiece 20. The cable retention fingers 450 have a tapered cross-sectional geometry as best shown in FIG. 4D. The cable retention fingers 450 have inside surfaces 451 that include cable clamping surfaces 452. In this exemplary embodiment, cable clamping surfaces 452 are grooves formed into the inside surfaces 451, but in alternative embodiments, the cable clamping surfaces 452 may be ridges, hatching or other similar surfaces for frictionally engaging an opposed surface. In this exemplary embodiment, the midpiece body 410 includes two cable retention fingers 450, however, one, three, four or more cable retention fingers 450 may be included in alternative embodiments.

FIGS. 5A, 5B, 5C and 5D show an exemplary embodiment of the rotating clamp 25. Rotating clamp 25 has an inside surface 510, a first opening 512, a second opening 516 and an outside surface 520. In this exemplary embodiment, the outside surface 520 has a generally circular cross-section having a tapered cylindrical geometry, and is substantially smooth. In alternative embodiments, the outside surface 520 may have any other cross-section including but not limited to rectangular, square or other parallelogram such as octagram or decagram, and may or may not be tapered, and may or may not have frictional features such as ribs, hatching, grooves or other similar features to enhance the physical engagement and rotation of the rotating clamp 25 by a user or installer. In other alternative embodiments, the exterior profile of rotating clamp 25 may be configured with sides capable of receiving a tool, wrench or other type of rotational tool. The outside surface 520 includes an opening 522 that may be used to assist engaging the rotating clamp 25 with a rotational tool, however, in alternative embodiments, the opening 522 may be deleted.

The inside surface 510 has a generally circular cross-section and a generally tapered cylindrical geometry as shown in FIGS. 5A-D. The inside surface 510 includes a front surface 517 and a mid-section 519. The inside surface 510 also includes rotating teeth 511, keys 514, and cable tightening ramps 518. The front surface 517 includes rotating teeth 511 and keys 514. The mid-section 519 has a tapered geometry between the front surface 517 and the cable tightening ramps 518. In alternative embodiments of the invention, the mid-section 519 may not be tapered or may be step-wise tapered. The rotating teeth 511 are radially disposed along the inside surface 510 proximate to the first opening 512. The rotating teeth 511 are configured to engage the teeth 421 of the sleeve 420 of the midpiece 20 (FIGS. 4A-D) to only permit the rotation in one direction of the rotating clamp 25 relative to the midpiece 20 when the rotating clamp 25 and midpiece 20 are securely assembled.

As further shown in FIGS. 5A-D, keys 514 are disposed on the inside surface 510 proximate to the rotating teeth 511. The keys 514 are configured to pass through slots 441 in retaining ring 440 of the midpiece 20 when the rotating clamp 25 and the midpiece 20 (FIGS. 4A-D) are securely assembled. In other words, key 514 and slot 441 must be aligned to securely assemble rotating clamp 25 to midpiece 20.

To securely assemble the rotating clamp 25 to the midpiece 20, the rotating clamp 25 is rotated in one direction with respect to the midpiece 20, such that keys 514 correspondingly rotate about the groove 430 (FIGS. 4A-D) until the rotating clamp 25 is securely assembled to the midpiece 20 and the keys 514 are disposed at a final position within the groove 430. The final position of the keys 514 in the groove 430 is out of alignment with the slot 441, thus axially securely assembling the rotating clamp 25 to the midpiece 20 and prohibiting the rotating clamp 25 and the midpiece 20 from being unassembled. Furthermore, the engagement of the rotating teeth 511 of the rotating clamp 25 with the teeth 421 of the sleeve 420 of the midpiece 20 prohibits the key 514 from being rotated in a direction opposite to the assembling rotational direction, thereby preventing an alignment of the keys 514 and the slots 441 after the rotating clamp 25 and midpiece 20 are securely assembled.

Figure 5A:
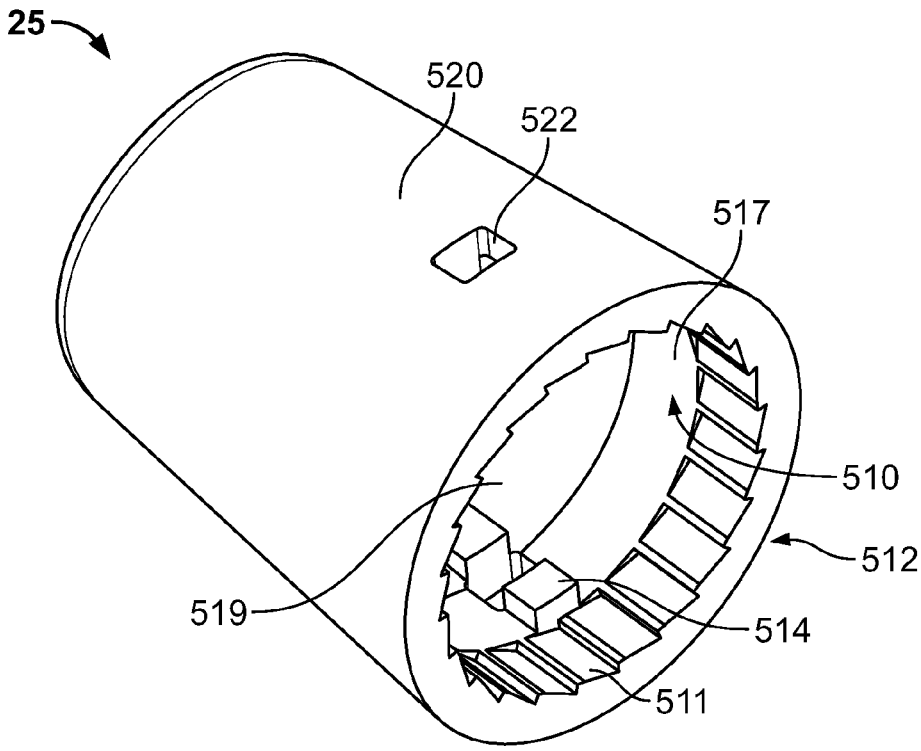
FIG. 5A illustrates a top perspective view of a rotating clamp according to an embodiment of the present invention.
Figure 5B:
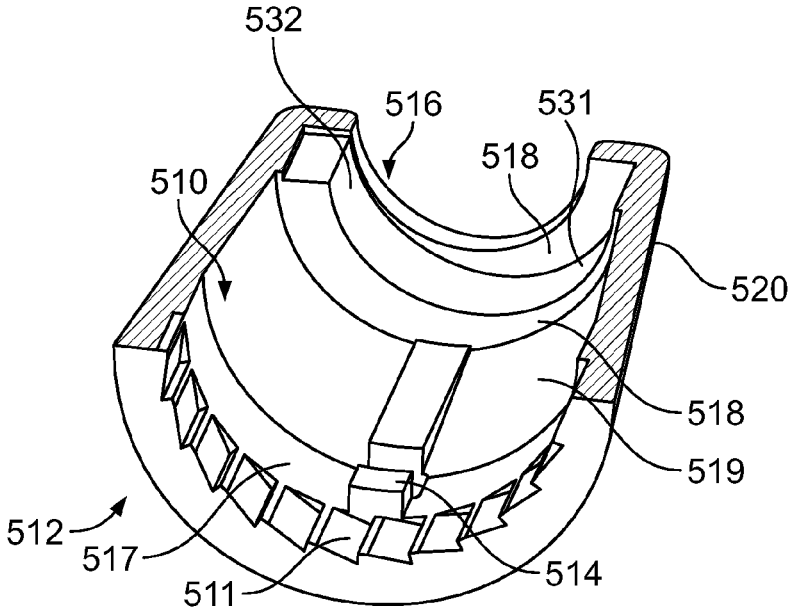
FIG. 5B illustrates a sectional view of the rotating clamp taken along line 5B-5B of FIG. 5D.
Figure 5C:
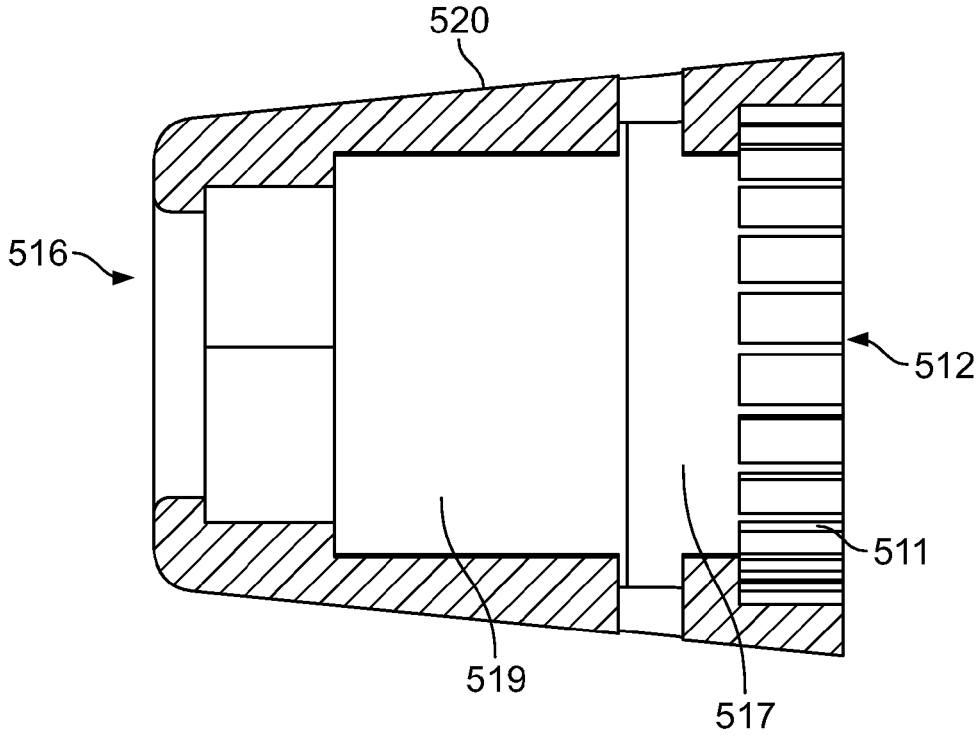
FIG. 5C illustrates a sectional view of the rotating clamp of taken along line 5C-5C of FIG. 5D.
Figure 5D:
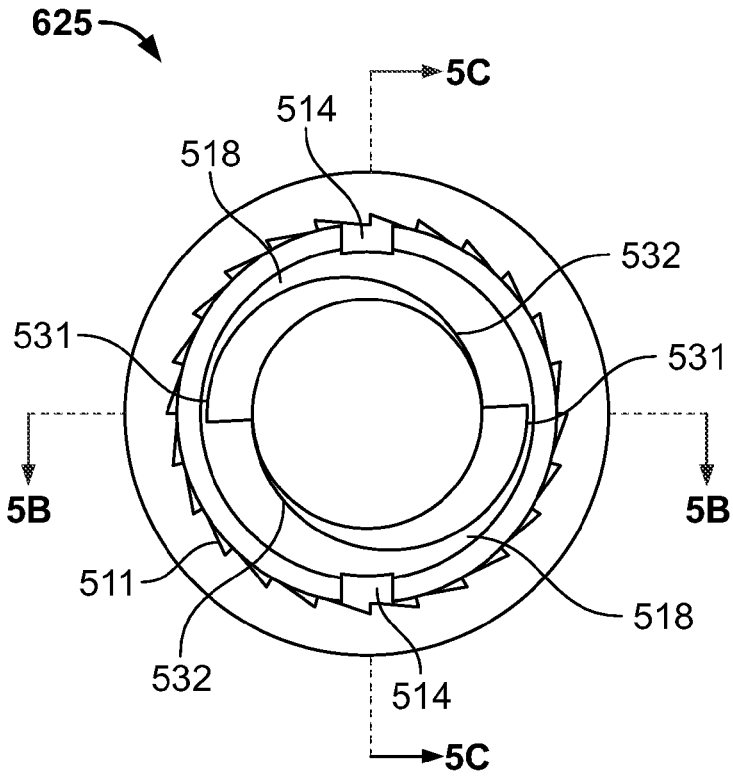
FIG. 5D illustrates a front orthographic view of the rotating clamp of FIG. 5A.

As further shown in FIGS. 5B-D, the cable tightening ramps 518 are disposed on the inside surface 510 proximate to the second opening 516. The cable tightening ramps 518, which are disposed to be slidably engaged with the cable retention fingers 450 when the rotating clamp 25 and the midpiece 20 are securely assembled, are configured to apply an increasing inwardly directed force on the cable retention fingers 450 (FIGS. 5A-D) of the midpiece 20 (FIGS. 5A-D) as the rotating clamp 25 is rotated with respect to the midpiece 20 during assembly of the rotating clamp 25 and the midpiece 20.

As shown in FIGS. 5A and 5D, the cable tightening ramps 518 have a generally radial wedge shape having thin edges 531 and thick edges 532. The keys 514 are radially positioned on the inside surface 510 so that when the keys 514 are received in the slots 441 (FIGS. 4A, 4B, 4D) and then first received into the groove 430, the cable retention fingers 450 (FIGS. 4A-D) are proximate and slidably engaged along the thin edges 531 of the cable tightening ramps 518. The rotating clamp 25 is then further securely assembled to the midpiece 20 (FIGS. 4A-D) by rotating the rotating clamp 25 in one direction relative to the midpiece 20, which slidably rotates the cable tightening ramps 518 about the cable retention fingers 450 toward the thick edges 532, thereby applying an increasing inwardly directed compressive force upon the cable retention fingers 450 until the rotating clamp 25 has reached a securely assembled position with respect to the midpiece 20. It should be apparent to one of ordinary skill in the art that the components could be configured to securely assemble the rotating clamp 25 to the midpiece 20 by rotating in the opposite direction.

The final securely assembled position of the rotating clamp 25 and the midpiece 20, which form the cable clamp 17, can further be discussed by referring to FIG. 2. As can be seen in FIG. 2, when the rotating clamp 25 is securely assembled to the midpiece 20, the cable retention fingers 450 securely contact the cable 40 to provide a strain relief. The dimensions of the rotating clamp 25 and the corresponding cable retention fingers 450 are selected for a particular sized cable 40 to ensure that the cable retention fingers 450 apply sufficient force to the cable 40 to provide strain relief to the wires 35 attached to the contacts 30. The cable clamp 17 thereby substantially prohibits the wires 35 from being physically and electrically disconnected from the contacts 30 under stresses that may be applied to the cable 40 under reasonable foreseeable operating conditions.

Figure 6:
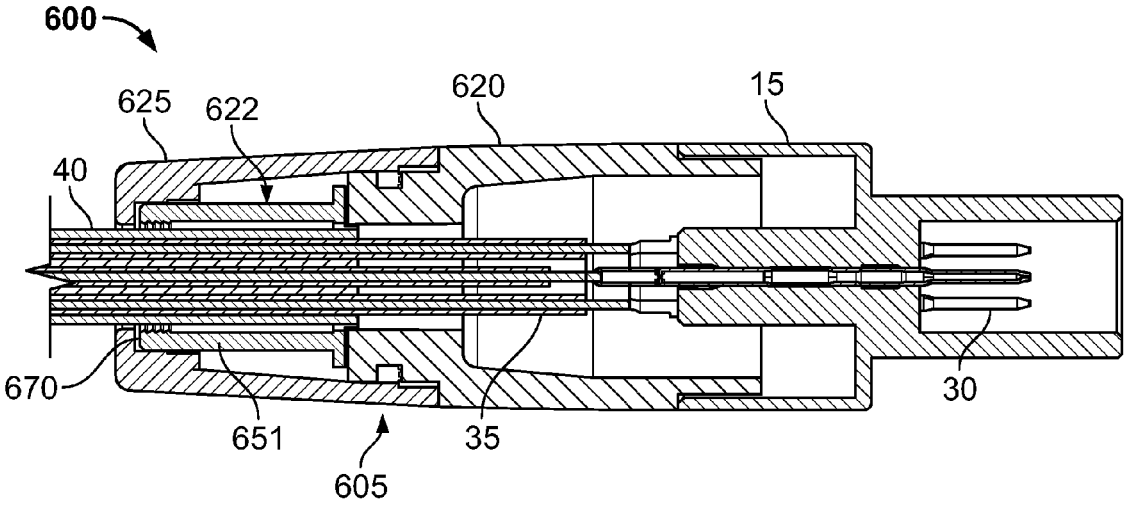
FIG. 6 illustrates a cross sectional view of an electrical connector according to another exemplary embodiment of the present invention.

An alternative exemplary embodiment of an electrical connector 600 for terminating wires 35 of cable 40 is shown in FIG. 6. The electrical connector 600 includes a housing 15 and a cable clamp 605. The housing 15 contains contacts 30, which terminate the wires 35. The number of wires 35 and contacts 30 may vary based on the application of the connector 600. The cable clamp 605 includes a midpiece 620, a rotating clamp 625, and a cable retention component 622. The housing 15 and the cable clamp 605 are shown having a generally rectangular cross-section, however, it should be apparent to one of ordinary skill that the cross-section of the housing 15 and cable clamp 605 may be square, circular or any other geometry.

Figure 7:
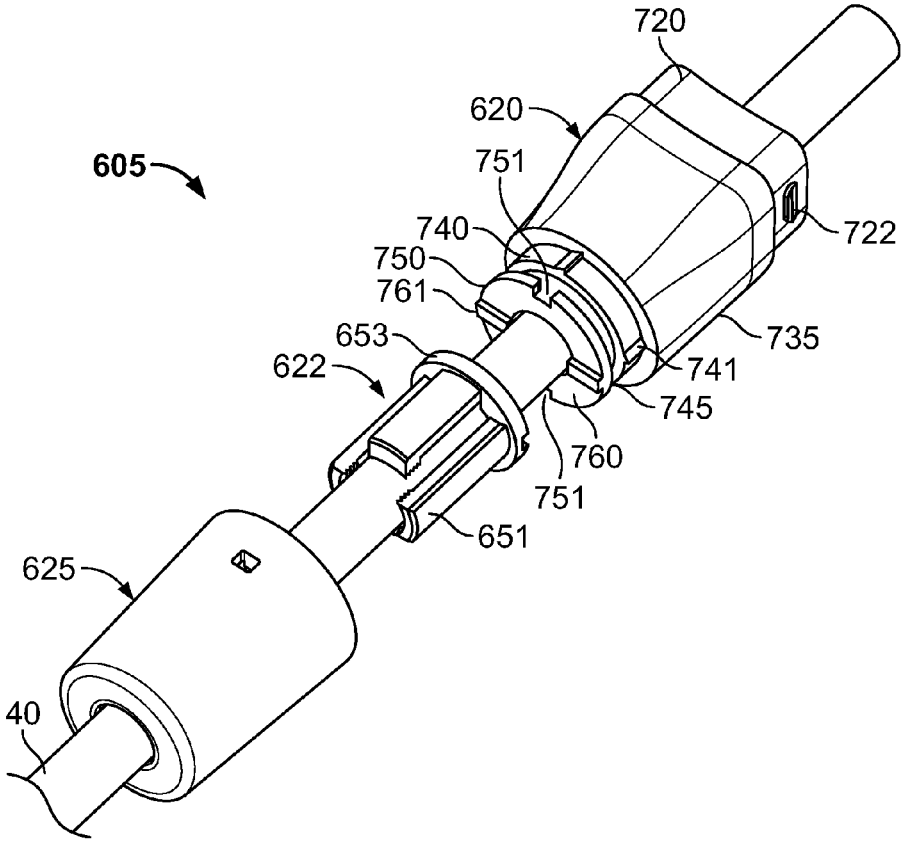
FIG. 7 illustrates an exploded view of an alternative embodiment of a cable clamp according to the invention.

An exploded view of the cable clamp 605 including midpiece 620, rotating clamp 625 and cable retention component 622 is shown in FIG. 7. As can be seen in FIG. 7, the midpiece 620 includes a connector aligning portion 720 having protrusions 722. The connector aligning portion 720 is sized to be received inside of housing 15 (FIG. 3). When the connector aligning portion 720 is fully received inside of housing 15 (FIG. 3), the protrusions 722 are received in recesses 310 (FIG. 3) to securely assemble the midpiece 620 and the housing 15 together.

The connector aligning portion 720 includes two protrusions 722 (a protrusion is present but not shown on the opposite side of the connector aligning portion 720), however, in alternative embodiments, the number and positioning of the protrusions 722 may vary. In alternative embodiments of the invention, the connector aligning portion 720 may include alternate and/or additional structures in place of the protrusions 722, and the housing 15 may be accordingly modified to engage such alternate and/or additional structure to assist in securely assembling the midpiece 620 to the housing 15, as would be further appreciated by one of ordinary skill in the art. Additionally, the connector aligning portion 720 and the midpiece 620 are shown to have a generally rectangular cross-section, however, in alternative embodiments, the cross-section of either or both components may be square, circular or any other geometry.

As can further be seen in FIG. 7, the midpiece 620 also includes a midpiece body 735, a sleeve 740, a groove 745, and a retention ring 750. The sleeve 740 includes sleeve teeth 741, and although the sleeve 740 includes four sleeve teeth 741 (two shown and two not shown but equally and oppositely spaced) equally spaced around the sleeve 740, any number of sleeve teeth 741 may be disposed in any spacing around the sleeve 740.

As also shown in FIG. 7, the retention ring 750 includes slots 751. Disposed between the sleeve 740 and retention ring 750 is groove 745, with retention ring 750 forming a defining surface of groove 745.

The midpiece 620 further includes a first surface 760. First surface 760 includes protrusions 761 for preventing rotation of the cable retention component 622 when the midpiece 620 and the rotating clamp 625 are securely assembled as shown in FIG. 6.

Figure 8A:
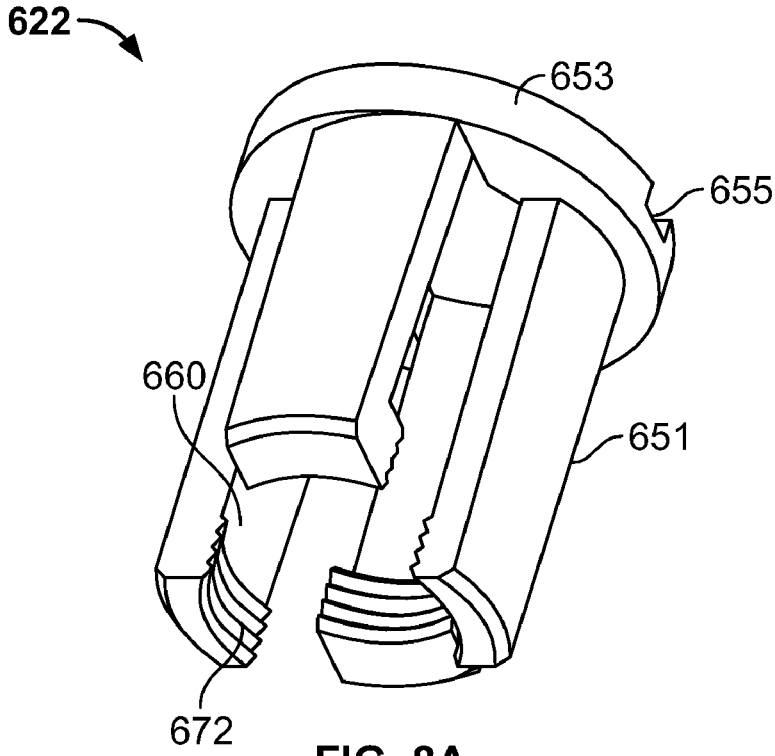
FIG. 8A illustrates a top perspective view of an exemplary cable retention component.
Figure 8B:
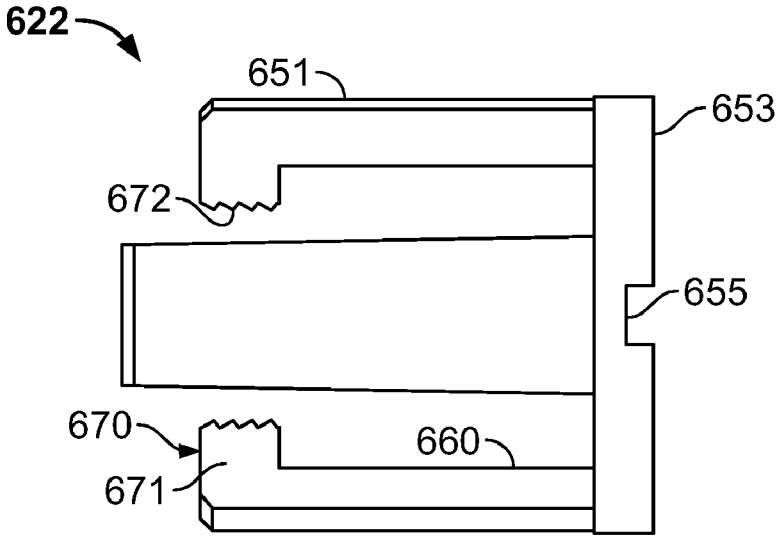
FIG. 8B illustrates a side orthographic view of the cable retention component of FIG. 8A.

The cable retention component 622 is shown in greater detail in FIGS. 8A and 8B. As can be seen in FIGS. 8A and 8B, the cable retention component 622 includes cable retention fingers 651 and a base 653. Base 653 includes a slot 655 configured to receive protrusions 761 (FIG. 7) of midpiece 620 (FIG. 7). The slot 655 should tightly fit with protrusions 761 (FIG. 7) so as to substantially prevent any rotation of the cable retention component 622 with respect to the midpiece 620 when engaged.

As shown in FIGS. 8A and 8B, cable retention fingers 651 are integrally formed with and extend away from the base 653. In this exemplary embodiment, four cable retention fingers 651 are provided, however, in alternative embodiments, two cable retention fingers 651 may be used in a configuration similar to the cable retention fingers 450 (FIG. 4A) of prior embodiment. Additionally, one, three or more than four cable retention fingers may be used. The four cable retention fingers 651 are provided as two pairs of oppositely opposed cable retention fingers 651 of different lengths as shown in FIGS. 8A, B.

The cable retention fingers 651 have a tapered cross-sectional geometry as further shown in FIGS. 8A, B. The cable retention fingers 651 have inside surfaces 660 that include cable clamping surfaces 670. In this exemplary embodiment, cable clamping surfaces 670 include protrusions 671 and grooves 672 formed into the protrusions 671, but in alternative embodiments, the cable clamping surfaces 670 may include may be ridges, hatching or other similar surfaces formed into the protrusions 671, or the cable clamping surfaces may be formed directly onto the inside surfaces 660. The cable clamping surfaces 670 frictionally engaging the cable 40 (FIG. 6).

FIGS. 9A, 9B, 9C and 9D show an exemplary embodiment of the rotating clamp 625. Rotating clamp 625 has an inside surface 910, a first opening 912, a second opening 916 and an outside surface 920. The outside surface 920 has a generally circular cross section having a tapered cylindrical geometry, and is substantially smooth. In alternative embodiments, the outside surface 920 may have any other cross-section including but not limited to rectangular, square or other parallelogram such as octagram or decagram, and may or may not be tapered, and may or may not have frictional features such as ribs, hatching, grooves or other similar features to enhance the physical engagement and rotation of the rotating clamp 625 by a user or installer. In other alternative embodiments, the exterior profile of rotating clamp 625 may be configured with sides capable of receiving a tool, wrench or other type of rotational tool. The outside surface 920 includes an opening 922 that may be used to assist engaging the rotating clamp 625 with a rotational tool, however, in alternative embodiments, the opening 922 may be deleted.

The inside surface 910 has a generally circular cross-section and a generally tapered cylindrical geometry as shown in FIGS. 9A-D. The inside surface 910 includes a front surface 917 and a mid-section 919. The inside surface 910 also includes rotating teeth 911, a key 914 and cable tightening ramps 918. The front surface 917 includes rotating teeth 911 and key 914. The mid-section 919 has a tapered geometry between the front surface 917 and the cable tightening ramps 918. In alternative embodiments of the invention, the mid-section 919 may not be tapered or may be step-wise tapered. The rotating teeth 911 are radially disposed along the front surface 917 proximate to the first opening 912. The rotating teeth 911 are configured to engage the teeth 741 of the sleeve 740 of the midpiece 620 (FIG. 7) when the rotating clamp 625 and midpiece 620 are securely assembled to only permit the rotation of the rotating clamp 625 relative to the midpiece 620 in one direction, similar to the configuration of the rotating teeth 511 (FIGS. 5A-D) and teeth 421 (FIGS. 4A-D) of the prior embodiment.

As further shown in FIGS. 9A-D, keys 914 are disposed on the inside surface 910 proximate to the rotating teeth 911. Keys 914 are configured to pass through slots 751 (FIG. 7) in retaining ring 750 of the midpiece 620 when the rotating clamp 625 and the midpiece 620 (FIG. 6) are first brought together to securely assemble the rotating clamp 625 to the midpiece 620. To further securely assemble the rotating clamp 625 to the midpiece 620, the rotating clamp 625 is then rotated about the midpiece 620, and the keys 914 correspondingly rotate about the groove 745 (FIG. 7) until the rotating clamp 625 is securely assembled to the midpiece 620 and the keys 914 are disposed at a final securely assembled position within the groove 745. The securely assembled position of the keys 914 in the groove 745 is out of alignment with the slots 751, thus axially securing the rotating clamp 625 to the midpiece 620 and prohibiting the rotating clamp 625 and the midpiece 620 from being unassembled. Furthermore, the engagement of the teeth 911 of the rotating clamp 625 with the teeth 741 of the sleeve 740 of the midpiece 620 prohibits the keys 914 from being rotated in the opposite direction in the groove 745, thereby preventing the rotating clamp 625 and the midpiece 620 from being unassembled. It should be apparent to one of ordinary skill in the art that the components could be configured to securely assemble the rotating clamp 625 to the midpiece 620 by rotating in the opposite direction.

Figure 9A:
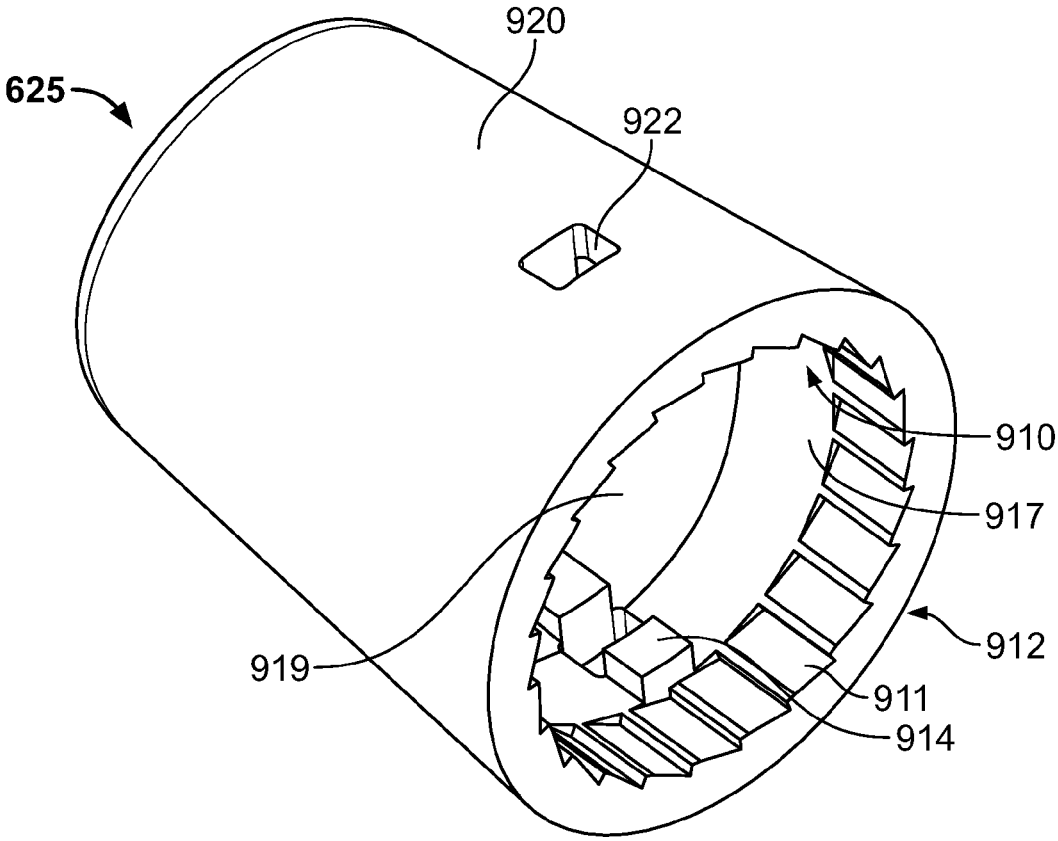
FIG. 9A illustrates a top perspective view of an alternative embodiment of a rotating clamp according to the invention.
Figure 9B:
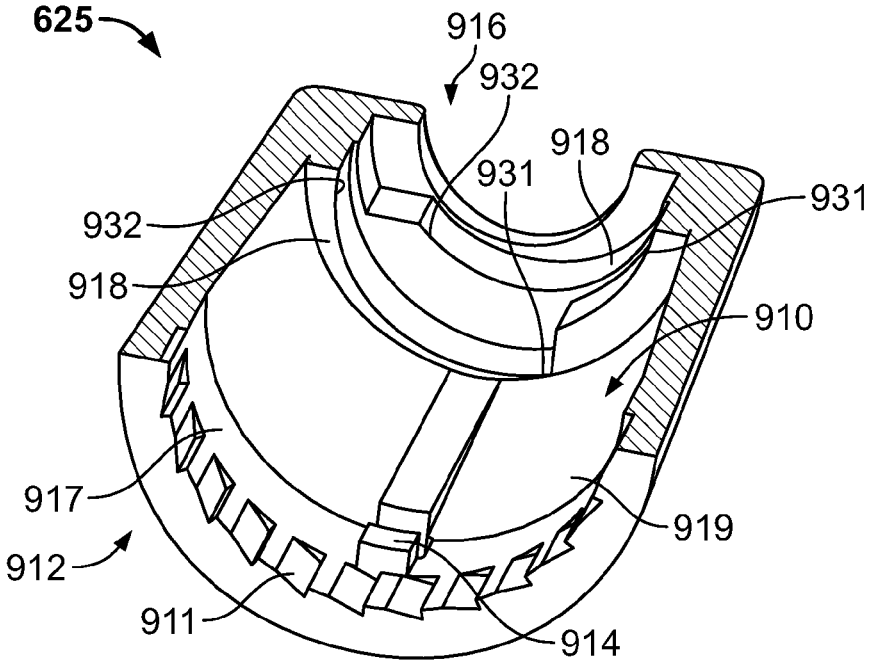
FIG. 9B illustrates a sectional view of the rotating clamp taken along line 9B-9B of FIG. 9D.
Figure 9C:
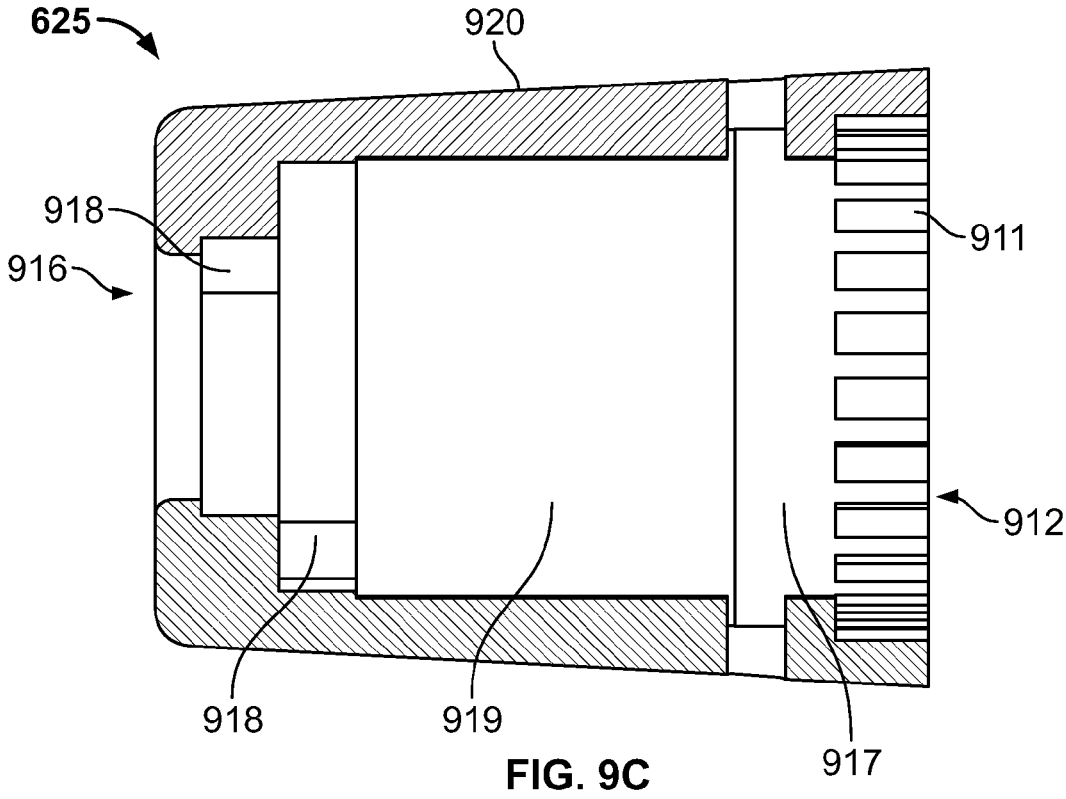
FIG. 9C illustrates a side sectional view of the rotating clamp taken along line 9C-9C of FIG. 9D.
Figure 9D:
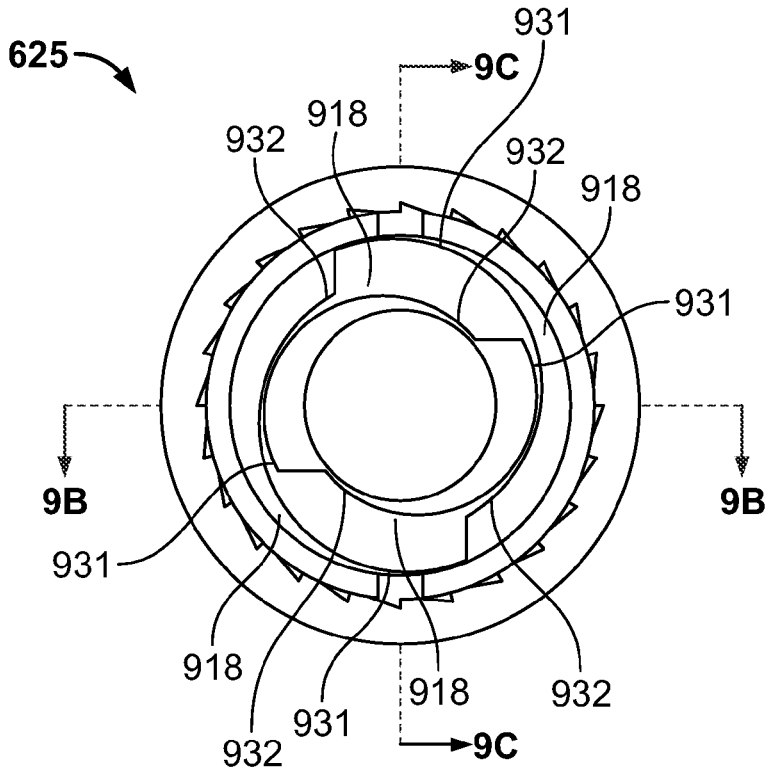
FIG. 9D is a front orthographic view of the rotating clamp of FIG. 9A.

As further shown in FIGS. 9B-D, the cable tightening ramps 918 are disposed on the inside surface 917 proximate to the second opening 916. Two pairs of cable tightening ramps 918 are located at different distances proximate to the second opening 916, configured to contact the cable retention fingers 651 (FIGS. 8A, B) of different lengths. The cable tightening ramps 918 are configured to apply an increasing force on the cable retention fingers 651 (FIGS. 8A,B) of the cable retention component 622 (FIG. 6) as the rotating clamp 625 is rotated on the midpiece 620 while securely assembling the rotating clamp 625 and the midpiece 620.

As shown in FIGS. 9B and 9D, the cable tightening ramps 918 have a generally radial wedge shape having thin edges 931 and thick edges 932. The key 914 is radially positioned on the inside surface 910 so that the cable retention fingers 651 (FIGS. 8A, B) are proximate the thin edge 931 when the rotating clamp 625 is first assembled to the midpiece 620 (FIG. 7) by receiving the key 914 in the slot 751 (FIG. 7) until the key 914 is first disposed in the groove 745 (FIG. 7). The rotating clamp 625 is then rotated with respect to the midpiece 620, which rotates the cable tightening ramps 918 in slidable engagement about the cable retention fingers 651 thereby applying an increasing inwardly directed compressive force upon the cable retention fingers 651 until the rotating clamp 625 has reached a final securely assembled position as shown in FIG. 6.

The final securely assembled position of the rotating clamp 625, the midpiece 620 and the cable retention component 622 which form the cable clamp 605, can further be discussed by referring to FIG. 6. As can be seen in FIG. 6, when the rotating clamp 625 is securely assembled to the midpiece 620, the cable retention fingers 651 are in contact with the cable 40. The dimensions of the rotating clamp 625 are selected for a particular sized cable 40 to ensure that the cable retention fingers 651 apply sufficient force to the cable 40 to provide strain relief to the wires 35 attached to the contacts 30, and in particular, the dimensions of the cable clamping surfaces 670 may be selected to apply sufficient force to the cable 40 to provide strain relief. The cable clamp 605 thereby substantially prohibits the wires 35 from being physically and electrically disconnected from the contacts 30 under stresses that may be applied to the cable 40 under reasonable foreseeable operating conditions.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector for terminating wires contained within a cable, comprising:

a housing comprising contacts; and a cable clamp attached to the housing, the cable clamp comprising:

a midpiece;

a rotating clamp securely assembled to the midpiece; and cable retention fingers disposed within the rotating clamp;

wherein the rotating clamp is configured to apply a force to the cable retention fingers, the cable retention fingers providing strain relief to the cable to prevent the wires from being physically and electrically disconnected from the contacts under nominal operating conditions, wherein the rotating clamp comprises ramps configured to apply an increasing force to the cable retention fingers as the rotating clamp is rotated upon the midpiece while assembling the rotating clamp to the midpiece.

2. The electrical connector of claim 1, wherein the ramps are radially shaped wedges disposed within the cable retention clamp.

3. The electrical connector of claim 1, wherein the cable retention fingers are integrally formed as a part of the midpiece.

4. The electrical connector of claim 3, wherein two cable retention fingers are integrally formed as a part of the midpiece.

5. The electrical connector of claim 3, wherein four cable retention fingers are integrally formed as a part of the midpiece.

6. The electrical connector of claim 1, wherein the cable retention fingers are integrally part of a cable retention component separate from the midpiece.

7. The electrical connector of claim 6, wherein two cable retention fingers are integrally part of a cable retention component separate from the midpiece.

8. The electrical connector of claim 6, wherein four cable retention fingers are integrally part of a cable retention component separate from the midpiece.

9. The electrical connector of claim 8, wherein four cable retention fingers are provided as two pairs of cable retention fingers including a first pair of the four cable retention fingers having a first length, and a second pair of the four cable retention fingers having a second length less than the first length.

10. A cable clamp for providing strain relief to a cable attached to an electrical connector housing, comprising:

a midpiece;

a rotating clamp securely assembled to the midpiece; and cable retention fingers disposed within the rotating clamp;

wherein the rotating clamp is configured to apply a force to the cable retention fingers, the cable retention fingers providing strain relief to the cable to prevent the wires from being physically and electrically disconnected from the contacts under nominal operating conditions, wherein the rotating clamp comprises ramps configured to apply an increasing force to the cable retention fingers as the rotating clamp is rotated upon the midpiece while assembling the rotating clamp to the midpiece.

11. The cable clamp of claim 10, wherein the ramps are radially shaped wedges disposed within the cable retention clamp.

12. The cable clamp of claim 10, wherein the cable retention fingers are integrally formed as a part of the midpiece.

13. The cable clamp of claim 12, wherein two cable retention fingers are integrally formed as a part of the midpiece.

14. The cable clamp of claim 12, wherein four cable retention fingers are integrally formed as a part of the midpiece.

15. The cable clamp of claim 10, wherein the cable retention fingers are integrally part of a cable retention component separate from the midpiece.

16. The cable clamp of claim 15, wherein two cable retention fingers are integrally part of a cable retention component separate from the midpiece.

17. The cable clamp of claim 15, wherein four cable retention fingers are integrally part of a cable retention component separate from the midpiece.

18. The cable clamp of claim 17, wherein four cable retention fingers are provided as two pairs of cable retention fingers including a first pair of the four cable retention fingers having a first length, and a second pair of the four cable retention fingers having a second length less than the first length.

* * * * *